US012630352B2

(12) United States Patent
Landau et al.

(10) Patent No.: US 12,630,352 B2
(45) Date of Patent: May 19, 2026

(54) SCENTED PILL ORGANIZER SYSTEM AND METHOD

(71) Applicants: Steven M. Landau, Meadowbrook, PA (US); Lisa Landau, Meadowbrook, PA (US)

(72) Inventors: Steven M. Landau, Meadowbrook, PA (US); Lisa Landau, Meadowbrook, PA (US)

( * ) Notice: Subject to any disclaimer, the term of this patent is extended or adjusted under 35 U.S.C. 154(b) by 0 days.

(21) Appl. No.: 18/452,478

(22) Filed: Aug. 18, 2023

(65) Prior Publication Data

US 2025/0058958 A1 Feb. 20, 2025

(51) Int. Cl.
*B65D 83/04* (2006.01)

(52) U.S. Cl.
CPC .. *B65D 83/0454* (2013.01); *B65D 2583/0409* (2013.01)

(58) Field of Classification Search
CPC ..... B65D 83/0454; B65D 2583/0409; A61J 7/04; A61J 7/0084
USPC ..... 206/204, 533, 538, 540
See application file for complete search history.

(56) References Cited

U.S. PATENT DOCUMENTS 2,317,882 A 4/1943 Boesel
5,114,003 A 5/1992 Jackisch et al.
5,762,199 A * 6/1998 Aguilera ..... B65D 83/0454 206/533
6,123,189 A 9/2000 Falkenberg et al.
6,571,942 B2 * 6/2003 Riemenschneider ..... B65D 81/266 206/204
7,202,484 B1 * 4/2007 Tantillo ..... A61L 2/10 34/209
7,547,893 B1 * 6/2009 Tantillo ..... A61L 9/12 250/455.11
7,793,785 B2 * 9/2010 Keffeler ..... A61J 7/04 206/532
8,622,241 B2 1/2014 Geboers et al.
8,672,185 B2 * 3/2014 Worthington ..... B05B 12/081 604/82
10,391,028 B2 8/2019 Deluca
2004/0018278 A1 1/2004 Popplewell et al.
2004/0222108 A1 11/2004 Tommarello et al.
2005/0172814 A1 8/2005 Brunk
2007/0227922 A1 * 10/2007 Chappell ..... A63B 60/56 206/315.1
2010/0300925 A1 * 12/2010 Kan ..... A61J 1/03 206/534

(Continued)

*Primary Examiner* — Luan K Bui
(74) *Attorney, Agent, or Firm* — LaMorte & Associates PC

(57) ABSTRACT

A system and method for altering the scent within a pill organizer. The pill organizer has multiple pill compartments and a scent compartment within a container housing. One or more perforated walls separate the scent compartment from the various pill compartments. A scent source that releases scent is placed in the scent compartment. The scent permeates into the various pill compartments. When a pill compartment is accessed by a user, the predominant scent perceived by the user is that of the scent source. In this manner, the user is not dissuaded from consuming pills, soft gels, tablets, gummies and/or capsules due to the odors that such items may release. The scented source can be replaced and/or renewed within the pill organizer. As such, the effectiveness of the overall product can be maintained for the life of the product.

12 Claims, 9 Drawing Sheets

(56) References Cited

U.S. PATENT DOCUMENTS

| | | | | |
|---|---|---|---|---|
| 2013/0213828 | A1 | 8/2013 | Chatterjee et al. | |
| 2014/0238889 | A1 | 8/2014 | Sunder et al. | |
| 2014/0262884 | A1* | 9/2014 | Priebe ..... | A61M 5/321<br>206/538 |

* cited by examiner

SCENTED PILL ORGANIZER SYSTEM AND METHOD

BACKGROUND OF THE INVENTION

1. Field of the Invention

In general, the present invention relates to devices where a scent source is added to the confines of a container for the purpose of supplementing or masking the natural scent of the product held within the container. The present invention also relates to the structure of pill organizers that are used to present specific pills, soft gels, tablets, and capsules for consumption on specific days.

2. Prior Art Description

Medications, vitamins, dietary supplements, and the like are often manufactured into pills, soft gels, tablets, gummies, or capsules to control dose size and to make the item easy to consume. The various pills, soft gels, tablets, gummies, and capsules are often packaged in an air-tight container. This prevents the pills, soft gels, tablets, gummies, and capsules from reacting with air and also prevents children from accessing the pills. Many medications, vitamins and/or dietary supplements have strong scents. Often these scents are unpleasant. The scent from a collection of pills or capsules collects within the container and is released each time the container is opened. Manufacturers do not want a customer to smell an unpleasant scent each time their product is used. As a consequence, some manufacturers package malodorous pills and capsules with scented inserts that emit a pleasant aroma into the headspace of the container packaging.

Although many pills, soft gels, tablets, gummies, and capsules are consumed directly out of their containers, many are placed in pill organizers for future consumption. Pill organizers have multiple compartments. Often the compartments are labelled for the days of the week or month. In this manner, a user can place the pills, soft gels, tablets, gummies and capsules they want to take each day into the appropriate compartment. The pill organizer then provides a visual indication as to whether or not the pills, soft gels, tablets and capsules have been taken in a timely manner.

A problem with the use of pill organizers is that if malodorous pills, soft gels, tablets, or capsules are placed into a compartment of a pill organizer, then there is nothing in the pill organizer to counteract the malodorous scent. Furthermore, pills, soft gels, tablets and capsules of different types may be placed together in the same compartments of the pill organizer. The scents of the pills, soft gels, tablets and/or capsules may intermingle in a manner that is highly unpleasant. This malodorous scent is very difficult to counteract because there is very little room in the compartments of a pill organizer for any scented material. Furthermore, each compartment in a pill organizer is separate and the use of scent in any one compartment would have no effect upon the contents of any other compartment. Furthermore, if any loose scented material were added to the compartments of a pill organizer, that material is at risk of being inadvertently consumed.

A need therefore exists for an improved system of adding scent to the confines of a pill container wherein scent can be shared between multiple compartments and where the scented material is protected from consumption. This need is met by the present invention as described and claimed below.

SUMMARY OF THE INVENTION

The present invention is a system and method for altering the scent within a pill organizer. The pill organizer has multiple pill compartments and a scent compartment within a container housing. Pills, soft gels, tablets, gummies, and/or capsules can be placed in the pill compartments. These items can be accessed by opening one or more lids that lead to the pill compartments. Within the container housing, one or more perforated walls separate the scent compartment from the various pill compartments.

A scent source is placed in the scent compartment. The scent source releases scent into the scent compartment. The scent permeates into the various pill compartments and surrounds the pills, soft gels, tablets, gummies and/or capsules being held within the pill compartments. When a pill compartment is accessed by a user, the predominant scent perceived by the user is that of the scent source, which in turn delivers a very pleasant aroma and subsequent taste experience. In this manner, the user is not dissuaded from consuming the stored pills, soft gels, tablets, gummies and/or capsules due to any malodors that such items may release, or the lack of pleasant aromas.

The scented source can be replaced and/or renewed within the pill organizer. As such, the effectiveness of the overall product can be maintained for the life of the product.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention system and method can be embodied in many ways, only a few exemplary embodiments are illustrated. The embodiments show various types of pill organizers. The embodiments are selected in order to set forth some of the best modes contemplated for the invention. The illustrated embodiments, however, are merely exemplary and should not be considered limitations when interpreting the scope of the appended claims.

Figure 1:
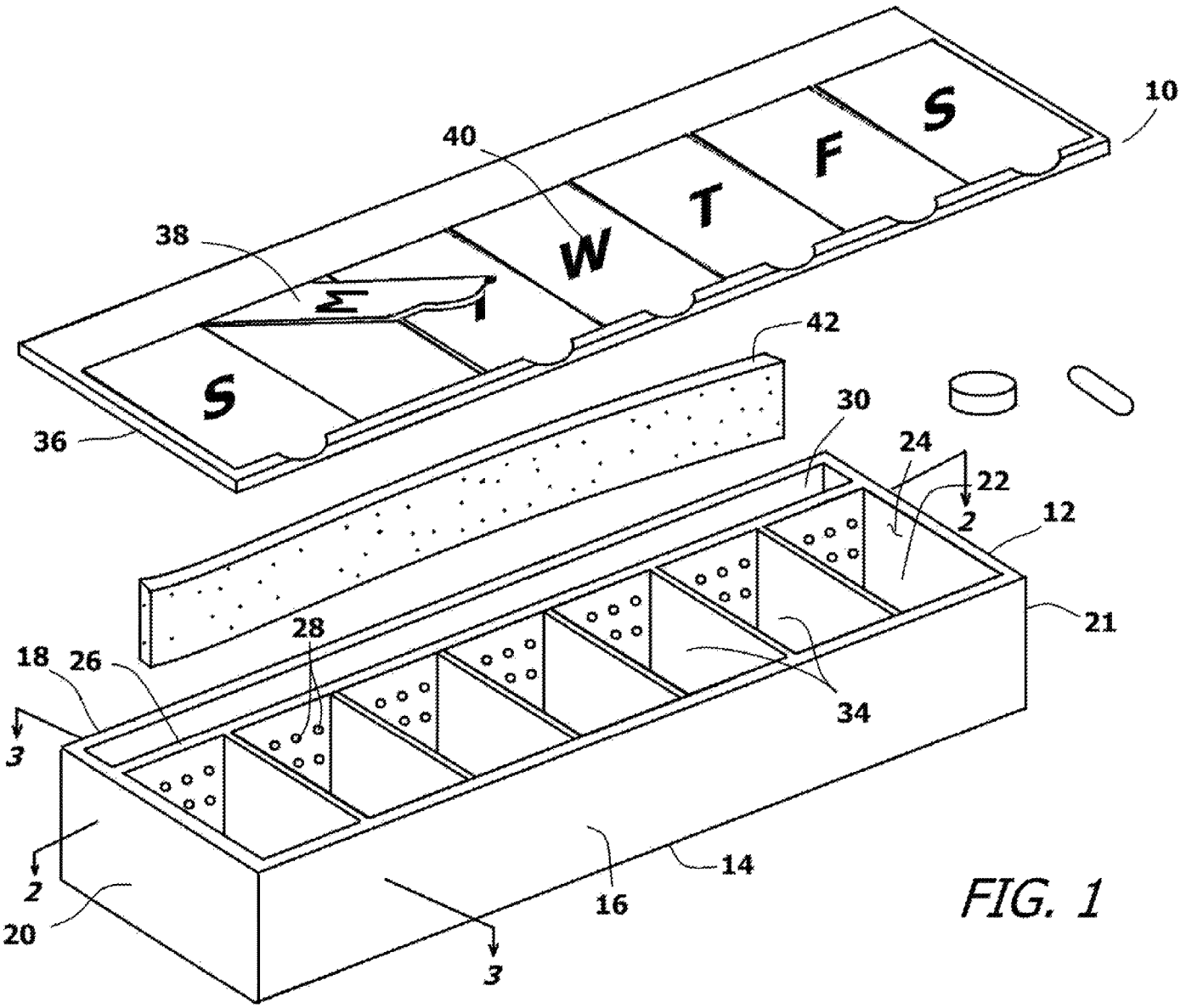
FIG. 1 shows a first exemplary embodiment of a scented pill organizer.
Figure 2:
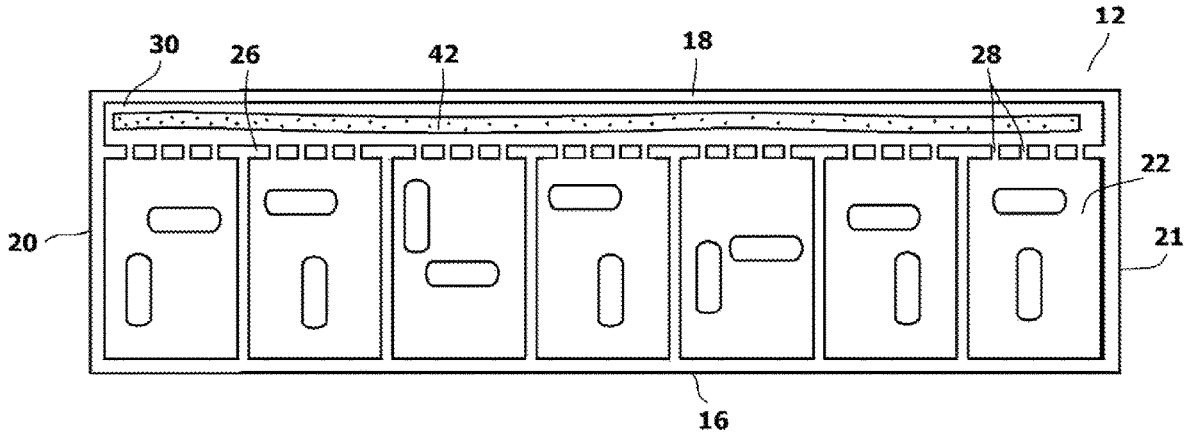
FIG. 2 is first cross-sectional view of the exemplary embodiment of FIG. 1, viewed along section line 2-2.
Figure 3:
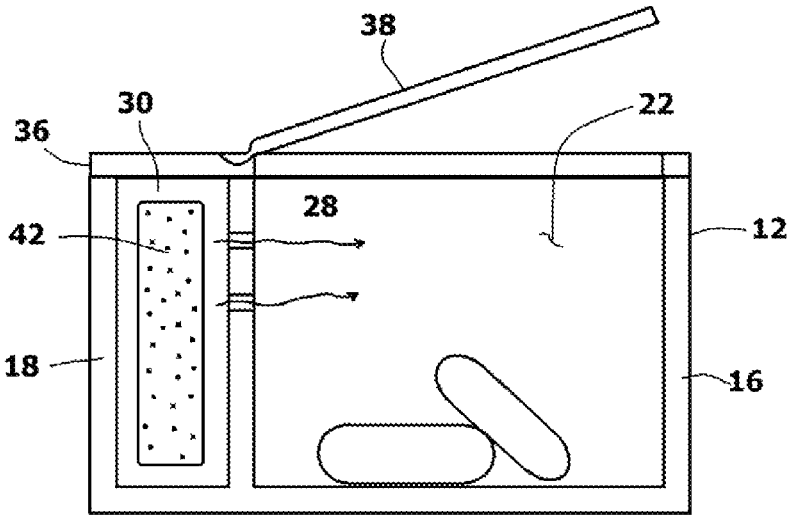
FIG. 3 is second cross-sectional view of the exemplary embodiment of FIG. 1, viewed along section line 3-3.

Referring to FIG. 1 in conjunction with FIG. 2 and FIG. 3, it can be seen that a linear pill organizer 10 is shown. The linear pill organizer 10 contains a rectangular container 12. The rectangular container 12 has a bottom surface 14 and four peripheral walls that extend upwardly along the periphery of the bottom surface 14. The four peripheral walls include a long front wall 16, a long rear wall 18 and two short side walls 20, 21. The front wall 16 and the rear wall 18 are parallel. Likewise, the short walls 20, 21 are parallel. The bottom surface 14 and the four peripheral walls 16, 18, 20, 21 define an internal compartment 22 with an open top 24.

Partition walls are used inside the rectangular container to segment the internal compartment into smaller compartments. A long partition wall 26 extends between the two short side walls 20, 21 within the internal compartment 22. The long partition wall 26 is parallel to the long rear wall 18 of the rectangular container 12. The long partition wall 26 contains air flow passages 28 for a reason that is later explained. The presence of the long partition wall 26 creates a long scent compartment 30 within the rectangular container 12. The scent compartment 30 is defined between the long rear wall 18, the long partition wall 26 and the two short side walls 20, 21.

Short partition walls 32 extend laterally from the long partition wall 26 to the front wall 16. The short partition walls 32 are all parallel to one another and are perpendicular to the long partition wall 26. The short partition walls 32 create pill compartments 34 between the long partition wall 26 and the front wall 16. Any number of pill compartments 34 can be present. However, seven pill compartments 34 are shown to create a one-week pill organizer 10, which is the most common type of pill organizer.

The long partition wall 26 contains air flow passages 28 in the form of mesh screen or perforations that provide access between the scent compartment 30 and the multiple pill compartments 34. The air flow passages 28 are large enough to enable air flow between the scent compartment 30 and the pill compartments 34. However, the air flow passages 28 are too small to enable any pill, capsule, tablet, or fragment thereof from passing between the pill compartments 34 and the scent compartment 30.

A lid assembly 36 is provided that can be selectively set atop the rectangular container 12 to cover the open top 24 of the rectangular container 12. The lid assembly 36 contains multiple hinged covers 38 that cover the pill compartments 34. The hinged covers 38 can contain graphics 40 that indicate numbers or days of the week, as is traditional for pill organizers. The lid assembly 36 can also be selectively removed to provide access to the scent compartment 30.

A scent source 42 is placed in the scent compartment 30 under the lid assembly 36. The scent source 42 can be any hygienic and/or non-toxic product that releases scent that counteracts the scent of the pills, soft gels, capsules, gummies and/or tablets being stored. The scent source 42 is preferably a replaceable piece of scented plastic. However, the scent source 42 can also be any material that can absorb and hold a small volume of a food-grade scented oil. The presence of the scent source 42 scents the air within the scent compartment 30. Since the air flow passages 28 in the long partition wall 26 enable air to pass between the scent compartment 30 and the pill compartments 34, the scent can permeate into the various pill compartments 34. Once in the pill compartments 34, the scented air becomes the dominant scent, therein minimizing any malodorous scents presented by pills, soft gels, tablets, gummies or capsules in the pill organizer 10.

Over time, the scent emitted by the scent source 42 may diminish. When this happens, the lid assembly 36 is detached and the scent source 42 is replaced or rehydrated with an appropriate scented oil. Likewise, if the scent released by the scent source 42 does not do well at masking the scent of the pills, soft gels, tablets, gummies, or capsules, then the scented source 42 can be replaced with another that emits a more effective scent.

Figure 4:
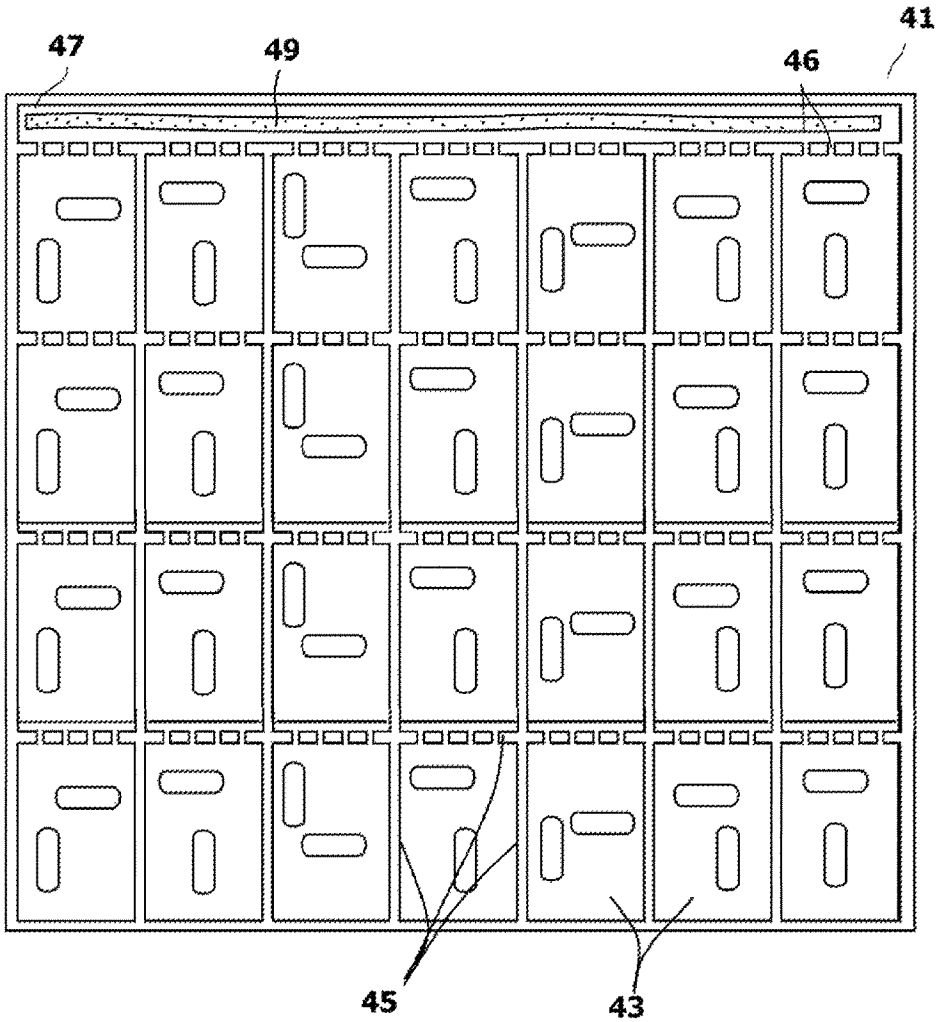
FIG. 4 shows a second exemplary embodiment of a scented pill organizer.

In the embodiment of FIG. 1, the pill organizer 10 is configured with seven pill compartments 34 for weekly use. Such a configuration is exemplary. Referring to FIG. 4, an alternate embodiment of a pill organizer 41 is shown that contains twenty-eight pill compartments 43. The pill compartments 43 are defined by partition walls 45. At least one partition wall 45 defining each of the pill compartments 43 contains air flow passages 46. The air flow passages 46 enable scent from a scent compartment 47 to reach each of the pill compartments 43 from a scent source 49.

Figure 5:
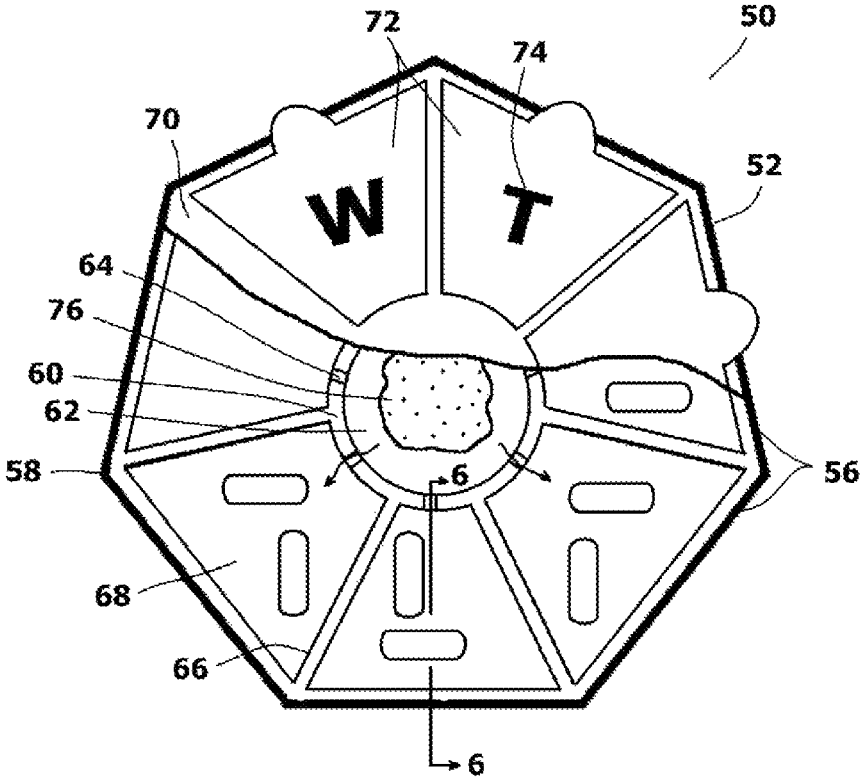
FIG. 5 shows a third exemplary embodiment of a scented pill organizer.
Figure 6:
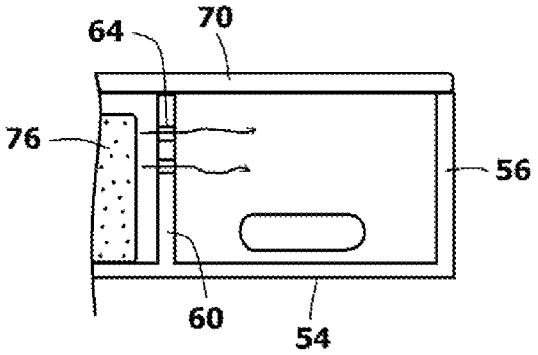
FIG. 6 is a cross-sectional view of the exemplary embodiment of FIG. 5, viewed along section line 6-6.

Referring to FIG. 5 and FIG. 6 an alternate embodiment of a pill organizer 50 is shown. In this embodiment, a polygonal pill organizer 50 is provided that has a polygonal container 52. The polygonal container 52 has a bottom surface 54 and multiple peripheral walls 56 that extend upwardly along the periphery of the bottom surface 54. The peripheral walls 56 are all the same length and intersect at salient points 58. An interior wall 60 is provided in the center of the polygonal container 52. The interior wall can be either polygonal or circular. The interior wall 60 defines a scent compartment 62 in the center of the polygonal container 52. The interior wall 60 contain air flow passages 64 for a purpose that is later described.

Partition walls 66 are used inside the polygonal container 52. The partition walls 66 extend from the interior wall 60 to the salient points 58 on the peripheral walls 56. The partition walls 66 create smaller pill compartments 68 within the polygonal container 52. Each pill compartment 68 is defined between the peripheral wall 66, the interior wall 60 and two of the partition walls 66. Any number of pill compartments 68 can be present. However, seven pill compartments 68 are shown to create a one-week pill organizer 50, which is the most common type of pill organizer.

The interior wall 60 has air flow passages 64 that are large enough to enable air flow between the scent compartment 62 and the pill compartments 68. However, the air flow passages 64 are too small to enable any pill, tablet or capsule or fragment thereof from passing between the pill compartments 68 and the scent compartment 62.

A lid assembly 70 is provided that can be selectively set atop the polygonal container 52 to cover the pill compartments 68 and the scent compartment 62. The lid assembly 70 contains multiple hinged covers 72 that cover the pill compartments 68. The hinged covers 72 can contain graphics 74 that indicate numbers or days of the week, as is traditional for pill organizers. The lid assembly 70 can also be selectively removed to provide access to the scent compartment 62.

A scent source 76 is placed in the scent compartment 62 under the lid assembly 70. The scent source 76 can be any hygienic and/or non-toxic product that releases scent that counteracts the scent of the pills, soft gels, capsules, gummies and/or tablets being stored. The scent source 76 is preferably a replaceable piece of scented plastic. However, the scent source can also be any material that can absorb and hold a small volume of a food-grade scented oil. The presence of the scent source 76 scents the air within the scent compartment 62. Since the air flow passages 64 in the long partition wall 66 enable air to pass between the scent compartment 62 and the pill compartments 68, the scent can permeate into the various pill compartments 68. Once in the pill compartments 68, the scented air becomes the dominant scent, therein minimizing any malodorous scents presented by pills, soft gels, tablets, gummies, or capsules in the pill container.

Figure 7:
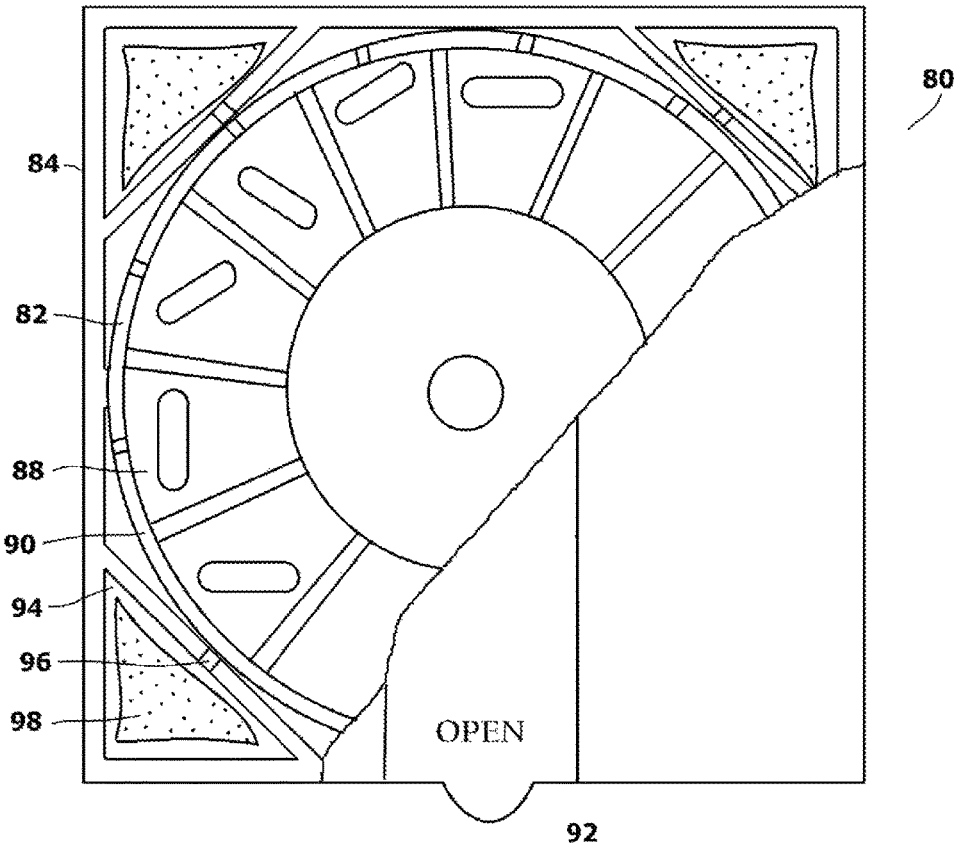
FIG. 7 shows a fourth exemplary embodiment of a scented pill organizer.

Referring to FIG. 7, an alternate embodiment of a pill organizer 80 is shown. In this embodiment, a dispensing wheel pill organizer 80 is provided that has circular pill container 82 that rotates within a stationary housing 84. The circular pill container 82 rotates about a central post 86 and contains multiple pill compartments 88 that are bound by a peripheral wall 90. The peripheral wall 90 is perforated. The housing 84 has a single opening 92. The circular pill container 82 rotates within the housing 84 so that the different pill compartments 88 rotate under the opening 92 one at a time.

Since the pill container 82 is round and the housing 84 is square, spaces exist between the circular pill container 82 and the housing 84 at the corners of the housing 84. One or more of these spaces can be used as a scent compartment 94. As the pill container 82 rotates in the housing 84, the peripheral wall 90 passes each scent compartment 94. The peripheral wall 90 has air flow passages/screens 96. The air flow passages/screens 96 are large enough to enable air flow between the scent compartment 94 and the pill compartments 88. However, the air flow passages 96 are too small to enable any pill, tablet, capsule, or fragment thereof from passing between the pill compartments 88 and the scent compartments 94.

A scent source 98 is placed into at least one of the scent compartments 94. The presence of the scent source 98 scents the air within the scent compartments 94. Since the air flow passages 96 in the peripheral wall 90 enable air to pass between the scent compartments 94 and the pill compartments 88, the scent can permeate into the various pill compartments 88. Once in the pill compartments 88, the scented air becomes the dominant scent, therein minimizing any malodorous scents presented by pills, soft gels, tablets, gummies, or capsules within the pill compartments 88.

Figure 8:
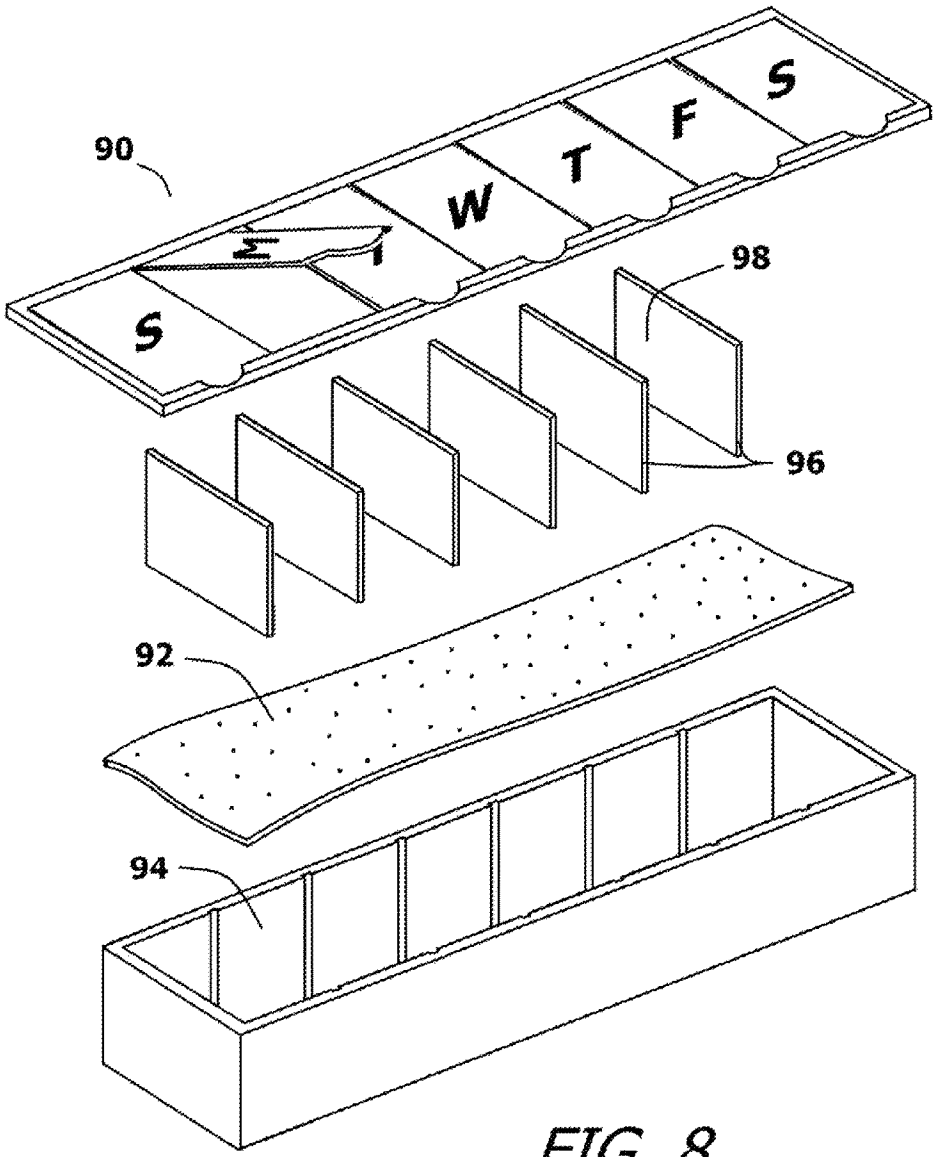
FIG. 8 shows a fifth exemplary embodiment of a scented pill organizer.

In all previous embodiments, a scent compartment is provided that is separate and distinct from the pill compartments. This need not be the case. Referring to FIG. 8, a pill container 90 is shown that has a scented lining 92. The scented lining 92 is placed along the bottom of the container 94. The partition walls 96 are placed over the scented lining 92. In this manner, the pill compartments 98 are each individually scented by the scented lining 92.

Figure 9:
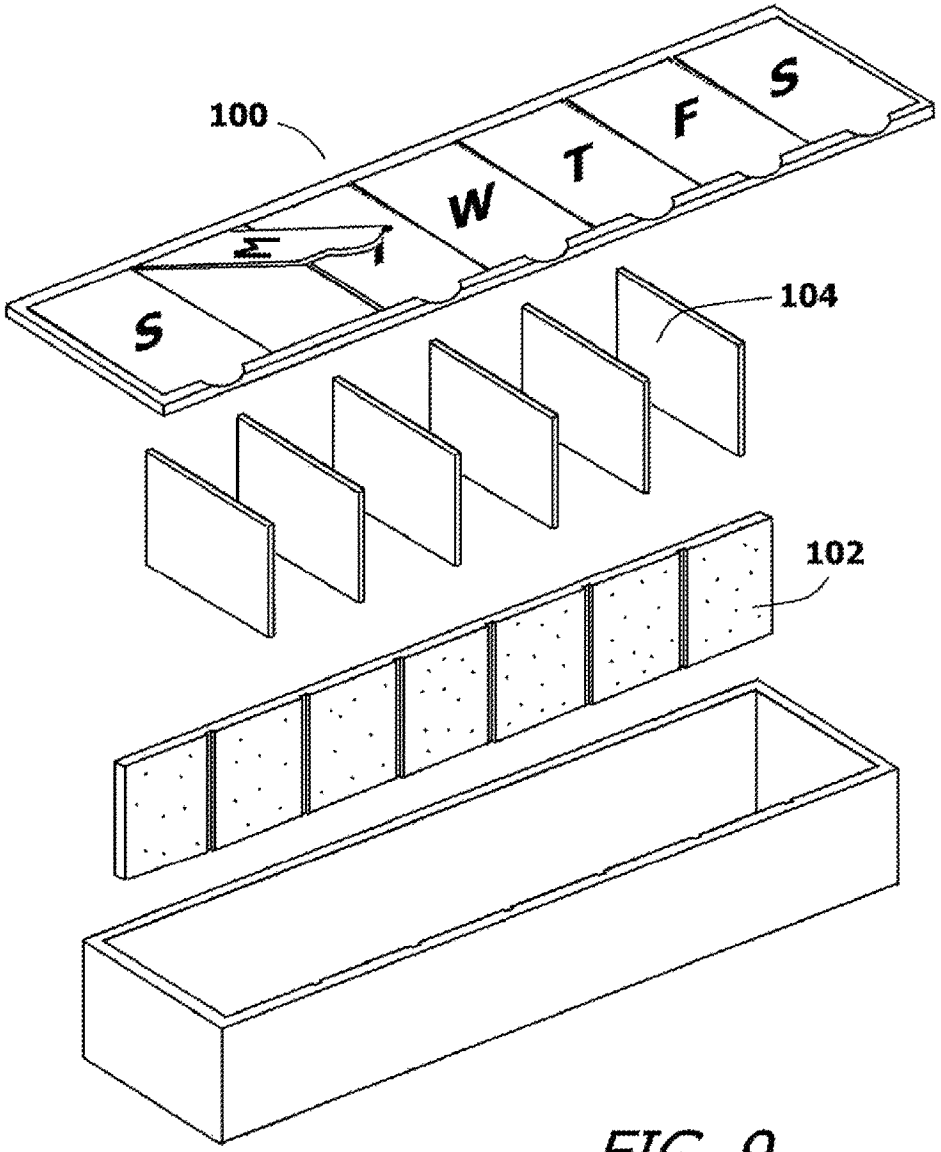
FIG. 9 shows a sixth exemplary embodiment of a scented pill organizer.

Referring to FIG. 9, a pill container 100 is shown having common partition wall 102 that forms part of all the pill compartments 104 within the pill container 100. The common partition wall 102 is scented. In this manner, the scent being released by the common partition wall 102 scents each of the pill compartments 104. The common partition wall 102 is preferably designed to be replaceable. In this manner, when the scent fades from the common partition wall 102, it can be replaced.

It will be understood that the embodiments of the present invention that are illustrated and described are merely exemplary and that a person skilled in the art can make many variations to those embodiments. For example, although pills are shown in the container, it will be understood that the pills can be capsules, soft gels, gummy vitamins, or any other variant of a consumable dosage for a medication or dietary supplement. Likewise, there are many other shapes and styles of pill organizers other than those illustrated. The present invention can be adapted to most other models, provided such models can be made with scent compartments. All such embodiments are intended to be included within the scope of the present invention as defined by the claims.

What is claimed is:

1. A pill organizer assembly, comprising:

a container having a bottom surface with a periphery, said container further including at least one peripheral wall that extends from said bottom surface along said periphery, wherein said bottom surface and said at least one peripheral wall define said container;

at least one interior wall that extends from said bottom surface within said container, wherein said at least one interior wall and said bottom surface define a central scent compartment within said container, wherein said at least one interior wall is perforated with multiple airflow passages;

a plurality of partition walls within said container that extend from said at least one peripheral wall to said at least one interior wall, wherein said plurality of partition walls, said at least one peripheral wall and said at least one interior wall define multiple pill compartments within said container, wherein said central scent compartment is exposed to said multiple pill compartments within said container by said multiple airflow passages; and a replaceable scent source positioned within said scent compartment, wherein said scent source releases scent that passes through said multiple airflow passages and is received within said multiple pill compartments within said container.

2. The assembly according to claim 1, further including lids for selectively covering each of said multiple pill compartments and said scent compartment.

3. The assembly according to claim 1, wherein said each of said multiple pill compartments is of equal shape and size.

4. The assembly according to claim 1, wherein said pill compartments are all positioned on one side of said scent compartment within said container.

5. The assembly according to claim 1, wherein said pill compartments encircle said scent compartment within said container.

6. The assembly according to claim 1, further including at least one access opening in said housing for selectively accessing said multiple pill compartments and said scent compartment, wherein said scent released by said replaceable scent source is trapped within said housing when said at least one access opening is closed.

7. A pill organizer assembly, comprising:

a housing having a bottom surface with a periphery and peripheral walls that extends from said bottom surface along said periphery, wherein said peripheral walls intersect at salient points and wherein said bottom surface and said at least one peripheral wall define said housing;

at least one interior wall that extends from said bottom surface within said housing, wherein said at least one interior wall and said bottom surface define a central scent compartment within said housing, and wherein said at least one interior wall is perforated with multiple airflow passages;

a plurality of partition walls within said housing that extend from said at least one interior wall to said salient points of said peripheral walls, wherein said plurality of partition walls, said at least one peripheral wall and said at least one interior wall define multiple pill compartments within said housing;

wherein air is free to pass through multiple airflow passages between said scent compartment and said multiple pill compartments within said housing;

a scent source positioned within said scent compartment, wherein said scent source releases scent that passes into said multiple pill compartments within said housing through multiple airflow passages; and at least one access opening in said housing for selectively accessing said multiple pill compartments and said scent compartment, wherein said scent released by said scent source is trapped within said housing when said at least one access opening is closed.

8. The assembly according to claim 7, wherein said pill compartments are all positioned on one side of said scent compartment within said housing.

9. The assembly according to claim 7, wherein said pill compartments encircle said scent compartment within said housing.

10. A method for altering the scent of pills housed within a pill organizer, said method comprising the steps of:

providing a pill organizer having a bottom surface with peripheral walls that defines a housing;

providing at least one interior wall that extends from said bottom surface within said housing, wherein said at least one interior wall and said bottom surface define a central scent compartment within said housing, and wherein said at least one interior wall is perforated with multiple airflow passages;

providing a plurality of partition walls within said housing that extend from said at least one interior wall to said peripheral walls, wherein said plurality of partition walls, said at least one peripheral wall and said at least one interior wall define multiple pill compartments within said housing;

placing a scent source within said scent compartment, wherein said scent source releases scent that passes into said multiple pill compartments through said multiple airflow passages; and placing a consumable in at least one of said multiple pill compartments, wherein said consumable is surrounded by said scent released by said scent source, wherein said consumable is selected from a group consisting of pills, soft gels, tablets, gummies and capsules.

11. The method according to claim 10, wherein providing said pill organizer includes providing said pill compartments on one side of said scent compartment within said housing.

12. The assembly according to claim 10, wherein providing said pill organizer includes encircling said scent compartment with said pill compartments within said housing.

* * * * *